US008616878B2

(12) United States Patent
Sato et al.

(10) Patent No.: US 8,616,878 B2
(45) Date of Patent: Dec. 31, 2013

(54) ADHESIVE LABEL MANUFACTURING DEVICE AND ADHESIVE LABEL MANUFACTURING METHOD

(75) Inventors: Yoshinori Sato, Chiba (JP); Norimitsu Sanbongi, Chiba (JP); Minoru Hoshino, Chiba (JP); Shuji Tozaki, Chiba (JP)

(73) Assignee: Seiko Instruments Inc. (JP)

( * ) Notice: Subject to any disclaimer, the term of this patent is extended or adjusted under 35 U.S.C. 154(b) by 849 days.

(21) Appl. No.: 12/592,862

(22) Filed: Dec. 3, 2009

(65) Prior Publication Data

US 2010/0183995 A1 Jul. 22, 2010

(30) Foreign Application Priority Data

Jan. 21, 2009 (JP) ..... 2009-010892

(51) Int. Cl.
*F27D 15/00* (2006.01)

(52) U.S. Cl.
USPC ..... 432/86; 432/8; 432/59; 432/228; 432/246; 492/46; 219/216; 148/566

(58) Field of Classification Search
USPC ..... 432/86
See application file for complete search history.

(56) References Cited

U.S. PATENT DOCUMENTS

| | | | | |
|---|---|---|---|---|
| 4,882,005 | A * | 11/1989 | Thompson | 156/470 |
| 5,573,621 | A * | 11/1996 | Boreali | 156/256 |
| 7,556,445 | B2 * | 7/2009 | Takahashi et al. | 400/120.01 |
| 2004/0218961 | A1 * | 11/2004 | Hoshino et al. | 400/120.01 |
| 2004/0257428 | A1 * | 12/2004 | Sato et al. | 347/220 |
| 2005/0189076 | A1 * | 9/2005 | Takahashi et al. | 156/359 |
| 2005/0208299 | A1 * | 9/2005 | Minamida et al. | 428/355 N |
| 2006/0130976 | A1 * | 6/2006 | Takahashi et al. | 156/384 |
| 2007/0058029 | A1 * | 3/2007 | Takahashi | 347/218 |
| 2007/0252886 | A1 * | 11/2007 | Sambongi et al. | 347/171 |
| 2008/0003039 | A1 * | 1/2008 | Sekino et al. | 400/188 |
| 2008/0003041 | A1 * | 1/2008 | Sekino et al. | 400/188 |
| 2008/0252000 | A1 * | 10/2008 | Dochi | 271/264 |

FOREIGN PATENT DOCUMENTS

| | | |
|---|---|---|
| EP | 1486337 | 12/2004 |
| EP | 1568613 | 8/2005 |
| EP | 1602500 | 12/2005 |
| EP | 2067702 | 6/2009 |
| WO | 9616889 | 6/1996 |

* cited by examiner

*Primary Examiner* — Kang Hu
*Assistant Examiner* — Nathaniel Herzfeld
(74) *Attorney, Agent, or Firm* — Adams & Wilks

(57) ABSTRACT

A heat-sensitive adhesive label manufacturing device has a thermal head for heating and thermally activating the heat-sensitive adhesive layer of a heat-sensitive adhesive sheet, and a platen roller for conveying the heat-sensitive adhesive sheet between the platen roller and the thermal head to transport the heat-sensitive adhesive sheet in a transport direction. At least one discharge roller is disposed on a downstream side of the thermal activation section and is configured to undergo rotation at a peripheral speed different from a peripheral speed of the platen roller to convey the heat-sensitive adhesive sheet in the transport direction. A guide member is disposed opposite and spaced apart from the at least one discharge roller to provide a space therebetween along which the heat-sensitive adhesive sheet is conveyed by the at least one discharge roller without being sandwiched between the at least one discharge roller and the guide member.

16 Claims, 7 Drawing Sheets

ADHESIVE LABEL MANUFACTURING DEVICE AND ADHESIVE LABEL MANUFACTURING METHOD

BACKGROUND OF THE INVENTION

1. Field of the Invention

The present invention relates to a heat-sensitive adhesive label manufacturing device and a heat-sensitive adhesive label manufacturing method.

2. Description of the Related Art

Conventionally, in order to manufacture a heat-sensitive adhesive label capable of adhering to various products, there is used a method in which a heat-sensitive adhesive layer provided on one side of a heat-sensitive adhesive sheet is heated and thermally activated to exhibit adhesive properties. As means for thermally activating the heat-sensitive adhesive layer, there is generally used a well-known thermal head which is widely adopted in a thermal printer. By using the thermal head, it is possible to easily cause the heat-sensitive adhesive layer to exhibit the adhesive properties partially, and to cause an adhesive part and a non-adhesive part to exist next to each other relatively freely. Note that, in some cases, the heat-sensitive adhesive label having a surface on which characters, symbols, designs, etc. are recorded is obtained by providing a heat-sensitive coloring layer on the other side of the heat-sensitive adhesive sheet, and partially heating the heat-sensitive coloring layer to develop color.

In the conventional heat-sensitive adhesive label manufacturing device for manufacturing the heat-sensitive adhesive label, the thermal head is arranged at a position of being brought into contact with the heat-sensitive adhesive layer as described above, and a platen roller is arranged at a position of being opposed to the thermal head. The platen roller presses the heat-sensitive adhesive sheet against the thermal head, and functions to convey the heat-sensitive adhesive sheet by its rotation. Further, in such a heat-sensitive adhesive label manufacturing device, a discharge roller is arranged on a downstream side of the thermal head and the platen roller, that is, between the thermal head and the platen roller, and a discharge port for the heat-sensitive adhesive label.

If the heat-sensitive adhesive sheet is stopped immediately at the point in time when a rear end portion of the heat-sensitive adhesive sheet moves away from a position of being brought into contact with the platen roller, there may arise a problem that the heat-sensitive adhesive sheet is held at a position of being brought into contact with the thermal head, and thus the heat-sensitive adhesive layer adheres to the thermal head, and a problem that, even though the heat-sensitive coloring layer is not directly brought into contact with a heating portion of the thermal head, the heat-sensitive coloring layer develops unexpected color due to transmission of heat at the contact position between the heat-sensitive adhesive sheet and the thermal head or in the vicinity of the contact position. Therefore, in order to convey the heat-sensitive adhesive sheet further on the downstream side and to cause the same to fully move away from the thermal head, the above-mentioned discharge roller is provided, the heat-sensitive adhesive sheet having the rear end portion which has moved away from the position of being brought into contact with the platen roller. Owing to provision of the discharge roller, the thermally-activated heat-sensitive adhesive sheet is separated from the thermal head, and it is possible to prevent the heat-sensitive adhesive layer from adhering to the thermal head, and to prevent the heat-sensitive coloring layer from developing unexpected color. In addition, the discharge roller holds the heat-sensitive adhesive label while lightly sandwiching the same between a guide member and the discharge roller in the vicinity of the discharge port, and functions to allow a user to easily take out the heat-sensitive adhesive label with a small force.

However, there is a risk that the heat-sensitive adhesive layer partially peels off and the heat-sensitive adhesive that has peeled off adheres to and deposits in an outer peripheral surface of the discharge roller. In this case, there is a risk that the heat-sensitive adhesive that has deposited in the outer peripheral surface of the discharge roller adheres to the subsequent heat-sensitive adhesive labels and inhibits advance of the heat-sensitive adhesive labels.

Therefore, non-adhesive coating is performed on the outer peripheral surface of the discharge roller. In addition, JP 2005-1139 A (Patent Document 1) proposes that discharge rollers (rotating bodies) are axially situated at intervals and have a plurality of wheel-shaped small protrusions, and an outer shape of the wheel-shaped protrusions is formed into a star shape or a gear shape, to thereby reduce a contact area with the heat-sensitive adhesive sheet and to reduce an amount of adhesion of the heat-sensitive adhesive. Further, JP 2005-239202 A (Patent Document 2) proposes that by shifting a position of a discharge roller (conveyor roller) to a side of the platen roller, the heat-sensitive adhesive sheet is easily separated from the thermal head, and thus stress generated on a contact surface between the heat-sensitive adhesive sheet and the discharge roller is reduced, to thereby prevent the heat-sensitive adhesive from adhering to the discharge roller.

According to the invention described in each of Patent Documents 1 and 2, it is possible to prevent, to some extent, the heat-sensitive adhesive from adhering to the discharge roller. However, the degree of prevention is not satisfactory. For example, even though the amount of adhesion is small, the heat-sensitive adhesive adheres to the outer peripheral surface of the discharge roller due to peeling-off, etc. of the non-adhesive coating of the outer peripheral surface of the discharge roller by a frictional force, the non-adhesive coating continuously coming into contact with the heat-sensitive adhesive sheet in accordance with use for a long period of time. As a result, the adhering heat-sensitive adhesive strongly fixes on a heat-sensitive adhesive of a subsequent heat-sensitive adhesive sheet, to thereby peel off the heat-sensitive adhesive. Therefore, once the heat-sensitive adhesive starts to adhere to the outer peripheral surface of the discharge roller, thereafter an amount of deposition of the heat-sensitive adhesive increases acceleratingly.

When the heat-sensitive adhesive adheres to and deposits in the outer peripheral surface of the discharge roller as described above, the adhesive strength between the discharge roller and the heat-sensitive adhesive sheet increases, and there is a risk that satisfactory conveyance of the heat-sensitive adhesive sheet cannot be performed. Specifically, as illustrated in FIG. 11, there is a risk that a heat-sensitive adhesive sheet 23, which is moved from a thermal head 21 and a platen roller 22, is dragged by a heat-sensitive adhesive 25 adhering to an outer peripheral surface of each of discharge rollers 24, and is wound around an outer periphery of one of the discharge rollers 24. Further, as illustrated in FIG. 12, there is a risk that a path for the heat-sensitive adhesive sheet 23 between the discharge rollers 24 and a guide member 26 is blocked by the heat-sensitive adhesive 25 adhering to the outer peripheral surface of each of the discharge rollers 24, and jamming (paper jam) occurs. Therefore, it is necessary to frequently exchange the discharge rollers 24, and to perform cleaning for removing the adhering heat-sensitive adhesive 25. Further, when the heat-sensitive adhesive 25 having relatively small adhesive strength exerted at the time of thermal activation is used in order to reduce the adhesion of the heat-sensitive adhesive 25 to the outer peripheral surface of each of the discharge rollers 24, the heat-sensitive adhesive 25 cannot obtain sufficient adhesive strength with respect to an adherend having a rough surface, and the heat-sensitive adhesive 25 may become unusable.

SUMMARY OF THE INVENTION

Therefore, an object of the present invention is to provide a heat-sensitive adhesive label manufacturing device and a heat-sensitive adhesive label manufacturing method capable of preventing the heat-sensitive adhesive from adhering to and depositing in the outer peripheral surface of the discharge roller.

The present invention is characterized in that a heat-sensitive adhesive label manufacturing device which manufactures a heat-sensitive adhesive label from a heat-sensitive adhesive sheet having a heat-sensitive adhesive layer includes: a thermal activation means for heating and thermally activating the heat-sensitive adhesive layer while being in contact with the heat-sensitive adhesive layer; a platen roller which is situated opposed to the thermal activation means; and a discharge roller which is situated on a downstream side of the thermal activation means and the platen roller and rotates at a peripheral speed different from a peripheral speed of the platen roller.

The discharge roller may have an outer diameter different from an outer diameter of the platen roller. Further, the discharge roller may be connected to a drive gear through an intermediation of a transmission gear having a gear ratio different from a gear ratio of a transmission gear for connecting the platen roller and the drive gear. Alternatively, the discharge roller and the platen roller may be driven by different drive means, respectively.

Another characteristic of the present invention is that a heat-sensitive adhesive label manufacturing method of manufacturing a heat-sensitive adhesive label from a heat-sensitive adhesive sheet having a heat-sensitive adhesive layer includes: rotating, in order to convey the heat-sensitive adhesive sheet, a platen roller situated opposed to a thermal activation means for heating the heat-sensitive adhesive layer; and rotating a discharge roller situated on a downstream side of the platen roller at a peripheral speed different from a peripheral speed of the platen roller.

The discharge roller may include a plurality of discharge rollers, and at least a discharge roller closest to the thermal activation means and the platen roller among the plurality of discharge rollers may be rotated at the peripheral speed different from the peripheral speed of the platen roller.

A difference in speed between the peripheral speed of the platen roller and the peripheral speed of the discharge roller is preferably 10% or more, and more preferably 20% or more to 50% or less.

According to the present invention, a difference in speed between the peripheral speed of the platen roller and the peripheral speed of the discharge roller is provided, and hence a period of time in which the heat-sensitive adhesive sheet is conveyed while the heat-sensitive adhesive layer of the heat-sensitive adhesive sheet and an outer peripheral surface of the discharge roller are held in contact with each other at one and the same position is reduced. As a result, it is possible to prevent the heat-sensitive adhesive from adhering to the outer peripheral surface of the discharge roller. Accordingly, it is possible to greatly reduce labor and time for maintenance, and to extend a lifetime of the discharge roller, and hence a running cost can be reduced. Further, it is unnecessary to consider a problem caused by the adhesion to the outer peripheral surface of the discharge roller, and hence a heat-sensitive adhesive can be used which can firmly adhere to an adherend having a rough surface and exerts strong adhesive strength.

DETAILED DESCRIPTION OF THE PREFERRED EMBODIMENT

Hereinafter, an embodiment of the present invention is described with reference to the drawings.

Figure 1A:
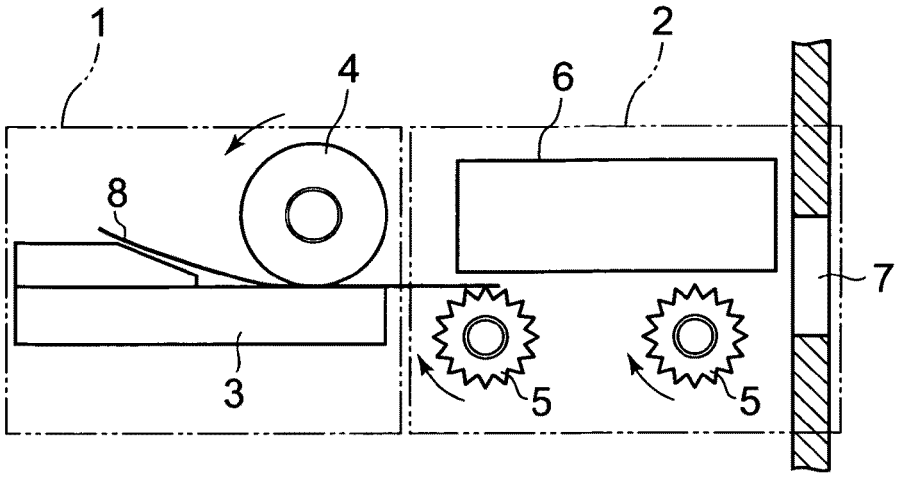
FIG. 1A is a sectional view illustrating a state of a main part of a heat-sensitive adhesive label manufacturing device according to an embodiment of the present invention at the time of thermal activation.
Figure 1B:
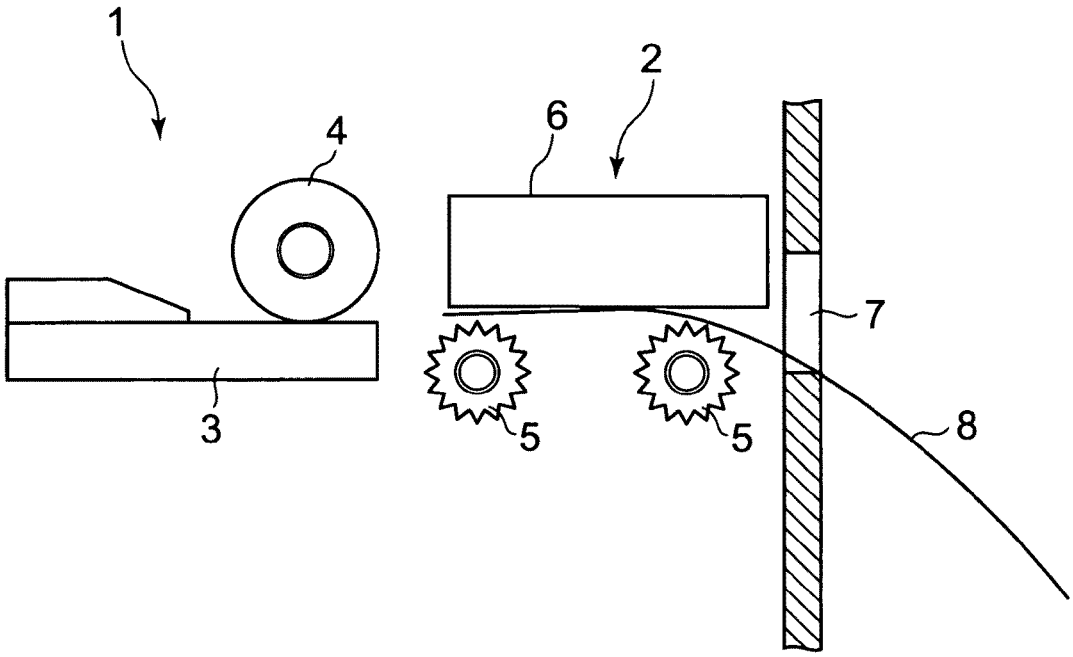
FIG. 1B is a sectional view illustrating a state after the thermal activation.

FIGS. 1A and 1B are schematic views illustrating a main part of a heat-sensitive adhesive label manufacturing device of the present invention. As illustrated in FIGS. 1A and 1B, the heat-sensitive adhesive label manufacturing device according to this embodiment includes a thermal activation section 1, and a label discharging section 2 situated on a downstream side of the thermal activation section 1. The thermal activation section 1 includes a thermal head 3 serving as thermal activation means, and a platen roller 4 situated opposed to the thermal head 3. The label discharging section 2 includes discharge rollers 5, and a guide member 6 situated opposed to the discharge rollers 5. A nip portion between the thermal head 3 and the platen roller 4, a gap between the discharge rollers 5 and the guide member 6, and a discharge port 7 opening toward an outside of a casing of the heat-sensitive adhesive label manufacturing device are aligned with each other to constitute a path for a heat-sensitive adhesive sheet 8 which is used as a heat-sensitive adhesive label. Note that, herein, a sheet which is obtained by cutting the heat-sensitive adhesive sheet 8 by a predetermined length and exerts adhesive strength is referred to as the heat-sensitive adhesive label. In the heat-sensitive adhesive label, a side opposite to an adhesive side (side on which a heat-sensitive adhesive layer exists) may be a recording side (side on which a heat-sensitive coloring layer exists) for characters, symbols, designs, etc. Further, in a mode illustrated in FIGS. 1A and 1B, cutting of the heat-sensitive adhesive sheet 8 by the predetermined length is already performed before the heat-sensitive adhesive sheet 8 enters the thermal activation section 1.

In such a configuration, when the heat-sensitive adhesive sheet 8 is fed to the thermal activation section 1 from an upstream side thereof in a state in which the heat-sensitive adhesive layer is faced toward the thermal head 3, the heat-sensitive adhesive sheet 8 is conveyed from left to right in the drawings by rotation of the platen roller 4, and the thermal head 3 is driven. As a result, the heat-sensitive adhesive layer is heated and thermally activated. The heat-sensitive adhesive layer 8, which has been thermally activated, exhibits adhesive properties. The thermally-activated heat-sensitive adhesive layer 8 (heat-sensitive adhesive label) further advances to the downstream side to reach the gap between the discharge rollers 5 and the guide member 6. Then, the heat-sensitive adhesive sheet 8 is further conveyed to the downstream side by rotation of the discharge rollers 5. Therefore, after a rearward end portion of the heat-sensitive adhesive sheet 8 (heat-sensitive adhesive label) moves away from a position of being brought into contact with the platen roller 4, the heat-sensitive adhesive sheet 8 (heat-sensitive adhesive label) is further conveyed to the downstream side by the discharge rollers 5, and does not remain at a contact position with the thermal head 3 or in the vicinity of the contact position. As illustrated in FIG. 1B, at a position at which the rearward end portion of the heat-sensitive adhesive sheet 8 (heat-sensitive adhesive label) fully moves away from the position of being brought into contact with the platen roller 4, the rotation of the discharge rollers 5 is stopped, and the heat-sensitive adhesive sheet 8 is held in a state in which a forward end portion thereof sticks out of the discharge port 7 toward the outside.

As described above, the heat-sensitive adhesive sheet 8 obtains a conveying force by the rotation of the platen roller 4 and the rotation of the discharge rollers 5. However, in the present invention, a peripheral speed of the platen roller 4 is not the same as that of the discharge rollers 5, and there is a difference in speed between both the rollers. Description is made below on a technical significance thereof.

The applicant of the present invention examined adhesion and deposition of a heat-sensitive adhesive 25 with respect to an outer peripheral surface of each of conventional discharge rollers 24 as described above, and considered that easy occurrence of the adhesion and deposition of the heat-sensitive adhesive 25 is attributed in part to the existence of a period of time in which a constant contact state between the thermally-activated heat-sensitive adhesive layer and the outer peripheral surface of each of the discharge rollers 24 is maintained. That is, it seems that, as a period of time becomes longer, in which a heat-sensitive adhesive sheet 23 is conveyed while the heat-sensitive adhesive layer and the outer peripheral surface of each of the discharge rollers 24 are held in contact with each other at one and the same position, there increases a risk that the heat-sensitive adhesive 25 adheres to the outer peripheral surface of each of the discharge rollers 24 at the contact position. Thus, the applicant of the present invention has conceived an idea that, when a period of time, in which the heat-sensitive adhesive layer and the outer peripheral surface of each of the discharge rollers are held in contact with each other at one and the same position, is reduced as possible and when there is no period of time enough for the heat-sensitive adhesive to adhere to the outer peripheral surface of each of the discharge rollers, it is possible to prevent the heat-sensitive adhesive from adhering to the outer peripheral surface of each of the discharge rollers.

In view of the above, in the present invention, there is provided a difference in speed between the peripheral speed of the discharge rollers 5 and the peripheral speed of the platen roller 4 which determines a conveying speed of the heat-sensitive adhesive sheet 8 at a point in time when the heat-sensitive adhesive sheet 8 enters the label discharging section 2. With this configuration, the discharge rollers 5 do not completely synchronize with the advance of the heat-sensitive adhesive sheet 8, whereas the discharge rollers rotate while slightly spinning without conveying the heat-sensitive adhesive sheet 8 (while slipping with respect to the heat-sensitive adhesive sheet 8).

Figure 2A:
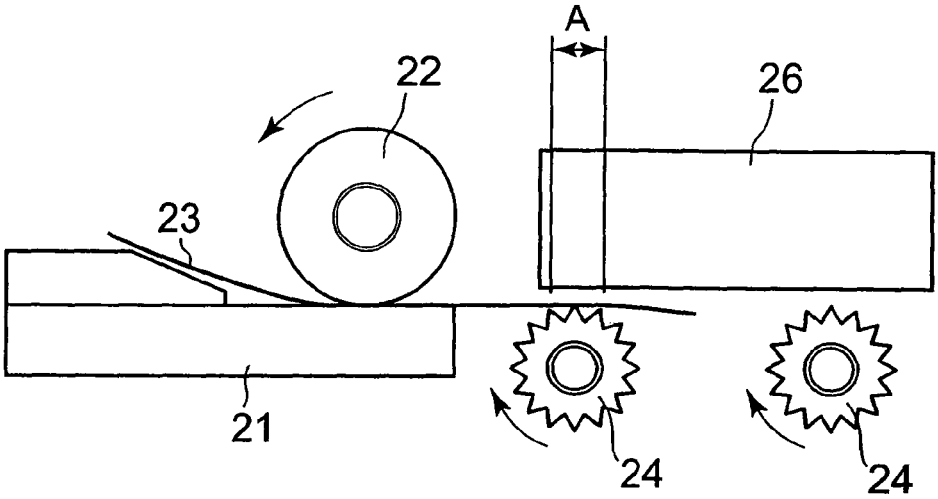
PRIOR ART FIG. 2A
FIG. 2A is a sectional view illustrating a state of a main part of a conventional heat-sensitive adhesive label manufacturing device while a heat-sensitive adhesive sheet is conveyed.
Figure 2B:
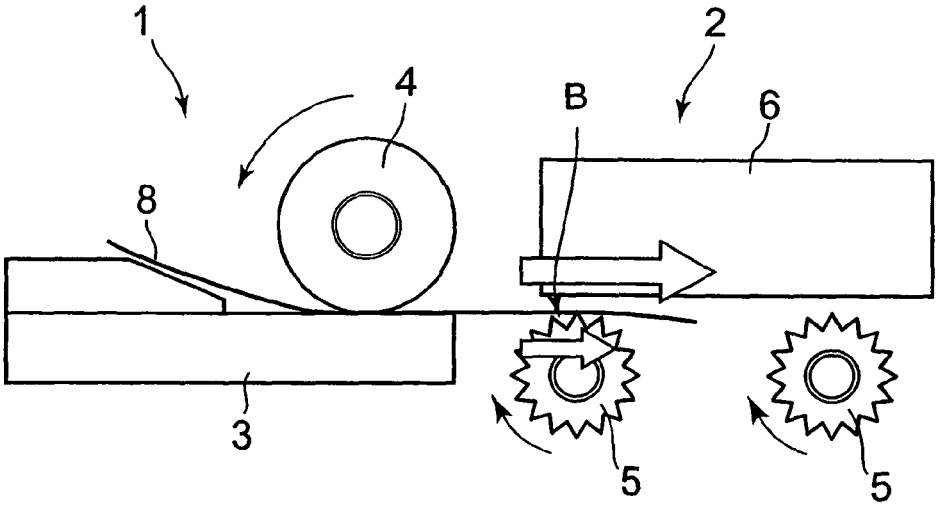
FIG. 2B is a sectional view illustrating a state of the main part of the heat-sensitive adhesive label manufacturing device according the embodiment of the present invention while a heat-sensitive adhesive sheet is conveyed.
Figure 11:
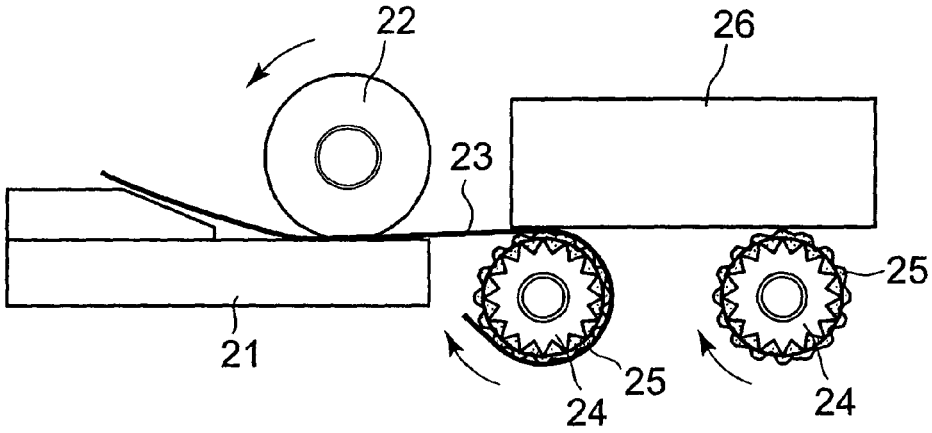
PRIOR ART FIG. 11
FIG. 11 is a sectional view illustrating a state in which the heat-sensitive adhesive sheet is wound around one of the discharge rollers in the conventional heat-sensitive adhesive label manufacturing device.
Figure 12:
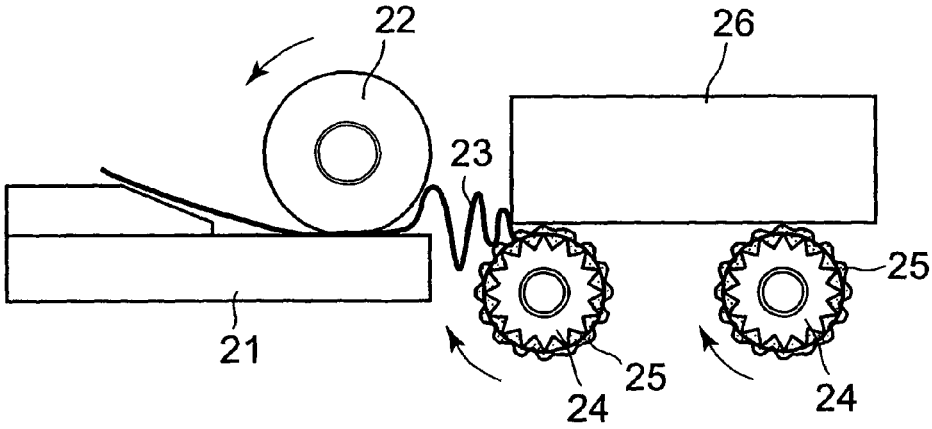
PRIOR ART FIG. 12
FIG. 12 is a sectional view illustrating a state in which the heat-sensitive adhesive sheet is jammed in the conventional heat-sensitive adhesive label manufacturing device.

When a peripheral speed of a platen roller 22 is the same as that of the discharge rollers 24 as in the conventional case, the contact state between the heat-sensitive adhesive layer and the outer peripheral surface of each of the discharge rollers 24 at one and the same position is maintained only in, for example, a region A illustrated in FIG. 2A. There is a risk that the heat-sensitive adhesive 25 (see FIGS. 11 and 12) adheres to the outer peripheral surface of each of the discharge rollers 24 while the contact state is maintained. In contrast, as illustrated in FIG. 2B, owing to provision of the difference in speed between the peripheral speed of the platen roller 4 and the peripheral speed of the discharge rollers 5, even when a portion B of the outer peripheral surface of each of the discharge rollers 5 comes into contact with a certain point in the heat-sensitive adhesive layer, the heat-sensitive adhesive sheet 8 slips with respect to the outer peripheral surface of each of the discharge rollers 5 in the next moment. As a result, the portion B comes into contact with another point in the heat-sensitive adhesive layer. Therefore, the period of time, in which the heat-sensitive adhesive layer and the outer peripheral surface of each of the discharge rollers 5 are held in contact with each other at one and the same position, becomes extremely short, and there is no period of contact time enough for a heat-sensitive adhesive 9 (see FIG. 4B) to adhere to the outer peripheral surface of each of the discharge rollers 5. As a result, it is possible to prevent the heat-sensitive adhesive 9 from adhering to the outer peripheral surface of each of the discharge rollers 5.

Figure 3:
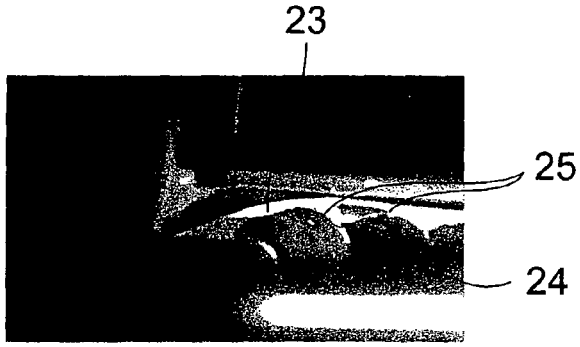
PRIOR ART FIG. 3
FIG. 3 is a perspective view illustrating a state in which the heat-sensitive adhesive sheet is conveyed in the conventional heat-sensitive adhesive label manufacturing device.
Figure 4A:
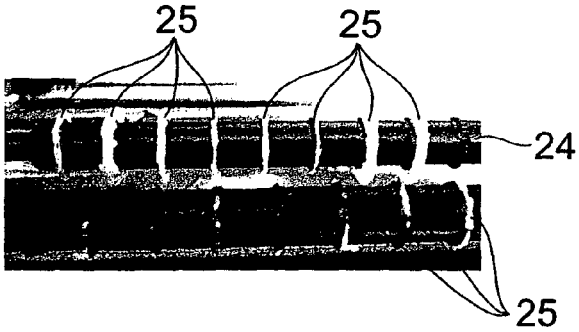
PRIOR ART FIG. 4A
FIG. 4A is a plane view of discharge rollers after the heat-sensitive adhesive sheet is conveyed in the conventional heat-sensitive adhesive label manufacturing device.

According to an experiment that the applicant of the present invention conducted, when the peripheral speed of the platen roller 22 is the same as that of the discharge rollers 24, as illustrated in FIGS. 3 and 4A, the heat-sensitive adhesive 25 is peeled away from the heat-sensitive adhesive sheet 23 to adhere to outer peripheral surfaces of gear-shaped protrusions of the discharge rollers 24, to thereby deposit in large quantities. When manufacture of the heat-sensitive adhesive label is continued in this state, there is an extremely high risk that winding of the heat-sensitive adhesive sheet 23 illustrated in FIG. 11 or jamming thereof illustrated in FIG. 12 occurs. Note that, FIG. 4A illustrates a state after the sum of lengths of the heat-sensitive adhesive sheets 23, which have been caused to pass through since the start of manufacture of the heat-sensitive adhesive label, reaches substantially a few hundred meters.

Figure 4B:
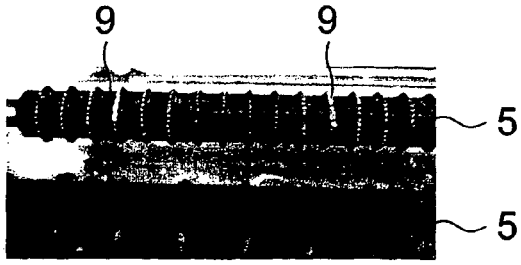
FIG. 4B is a plane view of discharge rollers after the heat-sensitive adhesive sheet is conveyed in the heat-sensitive adhesive label manufacturing device according to the embodiment of the present invention.

Meanwhile, when the peripheral speed of the discharge rollers 5 is set 0.7 times as high as the peripheral speed of the platen roller 4 on the basis of the present invention, peeling as illustrated in FIG. 3 of the heat-sensitive adhesive from the heat-sensitive adhesive sheet does not occur. FIG. 4B illustrates a state after the sum of lengths of the heat-sensitive adhesive sheets 8, which have been caused to pass through since the start of manufacture of the heat-sensitive adhesive label, reaches substantially a few kilometers. As described above, even after manufacture of the heat-sensitive adhesive label has been performed for a period of time several times as long as in the case of FIG. 4A, the heat-sensitive adhesive 9 adheres to and deposits in outer peripheral surfaces of gear-shaped protrusions of the discharge rollers 5 in extremely small quantities, and there is largely decreased a risk that winding of the heat-sensitive adhesive sheet similar to that of FIG. 11 or jamming thereof similar to that of FIG. 12 occurs.

Description is made on a specific configuration example for providing the difference in speed between the peripheral speed of the platen roller 4 and the peripheral speed of the discharge rollers 5 as described above.

Figure 5:
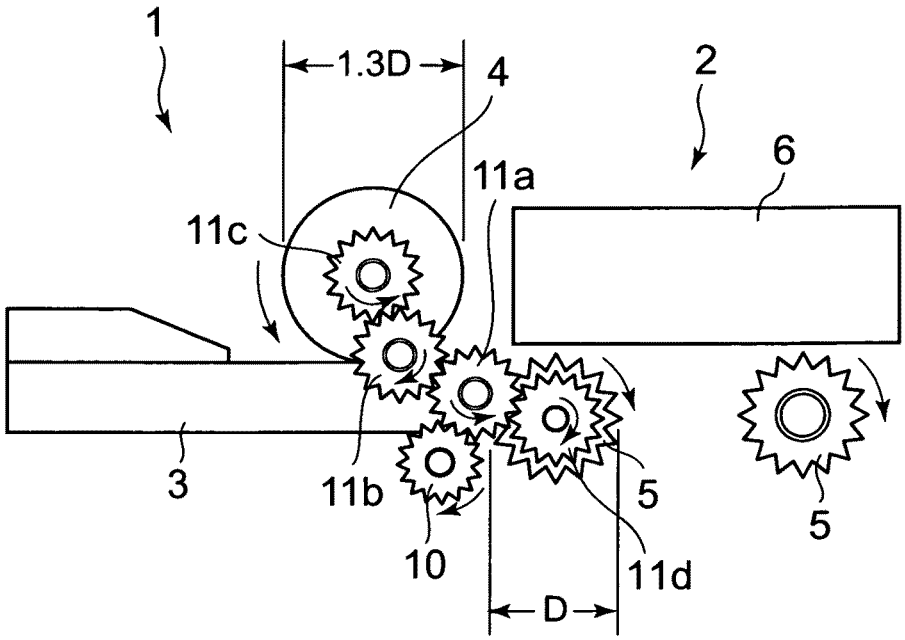
FIG. 5 is a sectional view illustrating a mode of a drive mechanism for a platen roller and the discharge rollers of the heat-sensitive adhesive label manufacturing device according to the embodiment of the present invention.

In the mode illustrated in FIG. 5, the platen roller 4 and the discharge rollers 5 are driven by a drive gear 10 connected to a drive motor (not shown) through the intermediation of transmission gears 11*a* to lid having the same number of teeth. However, an outer diameter of the platen roller 4 is set 1.3 times as large as an outer diameter D of the discharge rollers 5, and hence the peripheral speed of the platen roller 4 becomes 1.3 times as high as the peripheral speed of the discharge rollers 5.

Figure 6:
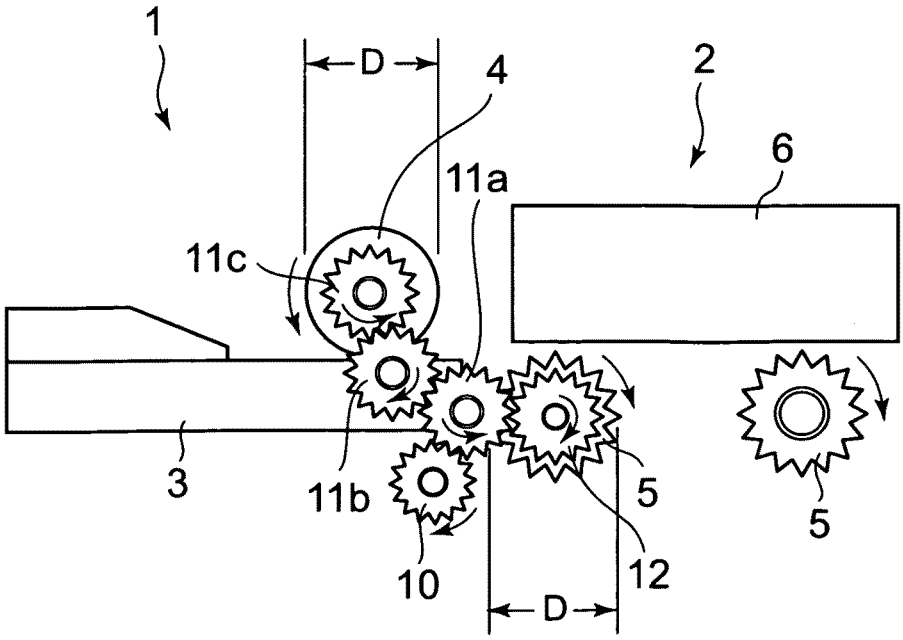
FIG. 6 is a sectional view illustrating another mode of the drive mechanism for the platen roller and the discharge rollers of the heat-sensitive adhesive label manufacturing device according to the embodiment of the present invention.

Further, in the mode illustrated in FIG. 6, the outer diameter of the platen roller 4 corresponds to the outer diameter D of the discharge rollers 5. The platen roller 4 is driven by the drive gear 10 connected to the drive motor (not shown) through the intermediation of the transmission gears 11*a* to 11*c*, whereas the discharge rollers 5 are driven by the drive gear 10 through the intermediation of the transmission gear 11*a* and a transmission gear 12. The transmission gear 12 has 1.5 times as large number of teeth as other gears 10 and 11*a* to 11*c* have. Therefore, the peripheral speed of the platen roller 4 becomes 1.5 times as high as the peripheral speed of the discharge rollers 5.

In combination with the configuration illustrated in FIG. 5 and the configuration illustrated in FIG. 6, the outer diameter of the platen roller 4 can be made different in size from the outer diameter D of the discharge rollers 5, and the number of the teeth of the transmission gears between the drive motor and the platen roller 4 can be made different from the number of the teeth of the transmission gears between the drive motor and the discharge rollers 5. With this configuration, it is possible to provide the difference in speed between the peripheral speed of the platen roller 4 and the peripheral speed of the discharge rollers 5.

Further, though not shown, the platen roller 4 and the discharge rollers 5 are driven by independent drive motors, respectively, and the rpm of each of the drive motors is changed. As a result, it is possible to provide the difference in speed between the peripheral speed of the platen roller 4 and the peripheral speed of the discharge rollers 5.

In the above-mentioned modes, the peripheral speed of the platen roller 4 is set higher than the peripheral speed of the discharge rollers 5. However, it is considered that the same effect can be obtained even when the peripheral speed of the discharge rollers 5 is set lower than the peripheral speed of the platen roller 4. However, if the peripheral speed of the discharge rollers is set zero, that is, when driven rollers that do not rotate actively are used as the discharge rollers, the heat-sensitive adhesive layer adheres to the thermal head and the heat-sensitive coloring layer develops unexpected color. In addition, the heat-sensitive adhesive adheres to the outer peripheral surfaces of the discharge rollers in large quantities to deposit therein.

In view of experimental confirmation by the applicant of the present invention, the difference in speed between the peripheral speed of the platen roller 4 and the peripheral speed of the discharge rollers 5 is required to be 10% or more. This is because when the difference in speed is small, the heat-sensitive adhesive sheet 8 adheres to the discharge rollers 5 due to the adhesive strength of the heat-sensitive adhesive 9 to advance in synchronization with the discharge rollers 5. When the difference in speed is 10% or more, preferably 20% or more, the heat-sensitive adhesive sheet 8 slips with respect to the discharge rollers 5, and continues to advance at the speed based on the rotation of the platen roller 4 out of synchronization with the rotation of the discharge rollers 5. Therefore, it is possible to achieve the above-mentioned effect of the present invention.

Meanwhile, when the difference in speed between the peripheral speed of the platen roller 4 and the peripheral speed of the discharge rollers 5 is extremely large, there is a high risk that the heat-sensitive adhesive layer of the heat-sensitive adhesive sheet 8 which slips with respect to the discharge rollers 5 is damaged in a case where the peripheral speed of the discharge rollers 5 is particularly high, and it becomes difficult to separate the rear end portion of the heat-sensitive adhesive sheet 8 from the thermal head 3 in a case where the peripheral speed of the discharge rollers 5 is low. However, when the difference in speed between the peripheral speed of the platen roller 4 and the peripheral speed of the discharge rollers 5 is 50% or less, it is possible to prevent the heat-sensitive adhesive layer of the heat-sensitive adhesive sheet 8 from being damaged and from adhering to the thermal head 3.

As described above, the most preferred difference in speed between the peripheral speed of the platen roller 4 and the peripheral speed of the discharge rollers 5 is 20% to 50%. The same holds true for a case where the platen roller 4 is higher or lower in speed than the discharge rollers 5.

Figure 7:
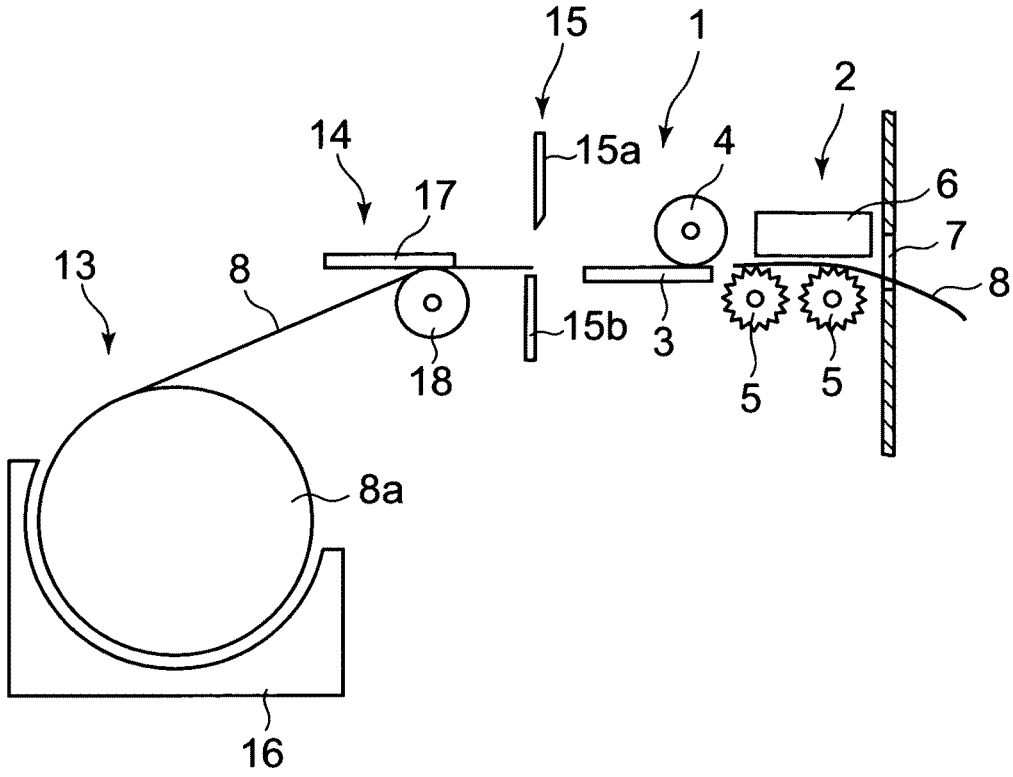
FIG. 7 is a sectional view of an entire configuration of the heat-sensitive adhesive label manufacturing device according to the embodiment of the present invention.

FIG. 7 illustrates an entire configuration example of the heat-sensitive adhesive label manufacturing device including the above-mentioned thermal activation section 1 and the label discharging section 2. In this heat-sensitive adhesive label manufacturing device, a roll body receiving section 13 for receiving a roll body 8*a* constituted by the heat-sensitive adhesive sheet 8 of continuous forms, a recording section 14, and a cutting section 15 are provided on the upstream side of the above-mentioned thermal activation section 1 and the label discharging section 2.

The roll body receiving section 13 includes a holding member 16 for holding the roll body 8*a*. The recording section 14 includes a thermal head 17 arranged at a position of being brought into contact with the heat-sensitive coloring layer of the heat-sensitive adhesive sheet 8, and a platen roller 18 opposed to the thermal head 17. The thermal head 17 has the same configuration as that of the above-mentioned thermal head 3 of the thermal activation section 1. The thermal heads 3 and 17 having the same configuration are provided to serve as heating means for recording and heating means for thermal activation. Thus, in comparison with a case where the heating means having different configurations are provided, it is possible to realize simplification of a control mechanism and a reduction in manufacturing cost. Similarly to the platen roller 4, the platen roller 18 imparts the conveying force to the heat-sensitive adhesive sheet 8 by the rotation thereof, and functions to bring the heat-sensitive adhesive sheet 8 into press-contact with the thermal head 17 at the time of recording. The cutting section 15 serves as a cutter including a movable blade 15*a* and a fixed blade 15*b*, and the movable blade 15*a* moves toward the fixed blade 15*b* so as to cut the heat-sensitive adhesive sheet 8 by sandwiching the same.

According to the heat-sensitive adhesive label manufacturing device, the heat-sensitive adhesive sheet 8 is drawn out from the roll body 8*a* held by the holding member 16 of the roll body receiving section 13, and is fed to the recording section 14. In the recording section 14, the platen roller 18 rotates to cause the heat-sensitive adhesive sheet 8 advance, and the thermal head 17 is driven to heat the heat-sensitive coloring layer of the heat-sensitive adhesive sheet 8, to thereby cause the heat-sensitive adhesive sheet 8 to develop color. The thermal head 17 includes a large number of heating elements that are independently driven, and the heating elements are selectively driven at appropriate timing. As a result, it is possible to record arbitrary characters, symbols, designs, etc. on the heat-sensitive coloring layer. The heat-sensitive adhesive sheet 8, which is subjected to recording on the heat-sensitive coloring layer as described above, is cut into a label having a predetermined length in the cutting section 15. The cut heat-sensitive adhesive sheet 8 is fed to the thermal activation section 1. In addition, as described above, the platen roller 4 rotates to cause the heat-sensitive adhesive sheet 8 to advance, and the thermal head 3 is driven to heat and thermally activate the heat-sensitive adhesive layer. Also in this case, the heating elements are selectively driven at the appropriate timing. As a result, only a desired part of the heat-sensitive adhesive layer exhibits the adhesive properties, and an adhesive part and a non-adhesive part can exist next to each other in one label relatively freely. The heat-sensitive adhesive sheet 8 (heat-sensitive adhesive label) activated thermally as described above is caused to further advance by the discharge rollers 5 of the label discharging section 2, and the rotation of the discharge rollers 5 is stopped in a state in which the forward end portion of the heat-sensitive adhesive sheet 8 sticks out of the discharge port 7 toward the outside to such an extent that a user can easily take out the heat-sensitive adhesive sheet 8. In this case, the rear portion of the heat-sensitive adhesive sheet 8 (heat-sensitive adhesive label) is held in the gap between the discharge rollers 5 and the guide member 6. In this way, there is completed the heat-sensitive adhesive label of a predetermined length which has one side (heat-sensitive coloring layer) on which desired recording is performed, and the opposite side (heat-sensitive adhesive layer) exhibiting the adhesive properties entirely or partially.

Note that, according to the heat-sensitive adhesive label manufacturing device, as described above, there is the difference in speed between the peripheral speed of the platen roller 4 of the thermal activation section 1 and the peripheral speed of the discharge rollers 5 of the label discharging section 2, and hence it is possible to prevent the heat-sensitive adhesive 9 from adhering to and depositing in the outer peripheral surface of each of the discharge rollers 5.

Figure 8:
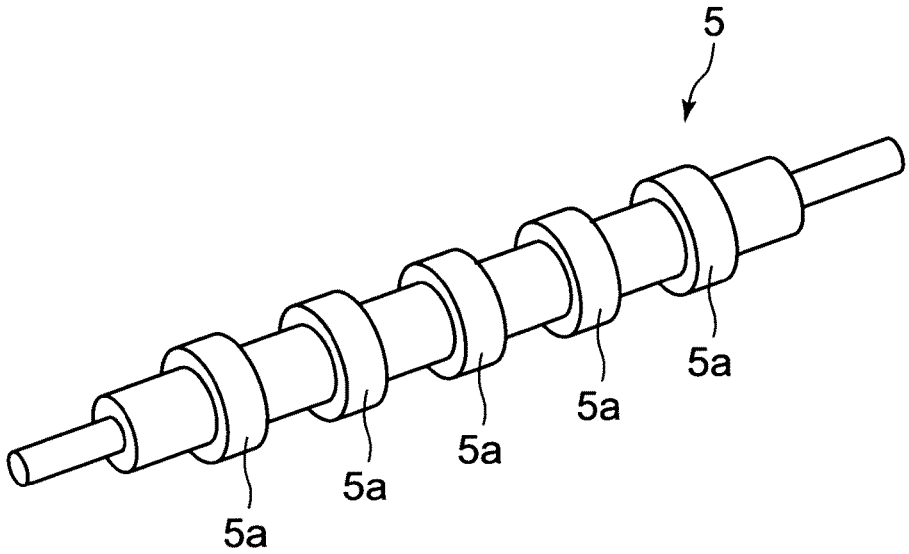
FIG. 8 is a perspective view illustrating a mode of the discharge rollers of the heat-sensitive adhesive label manufacturing device according to the embodiment of the present invention.
Figure 9:
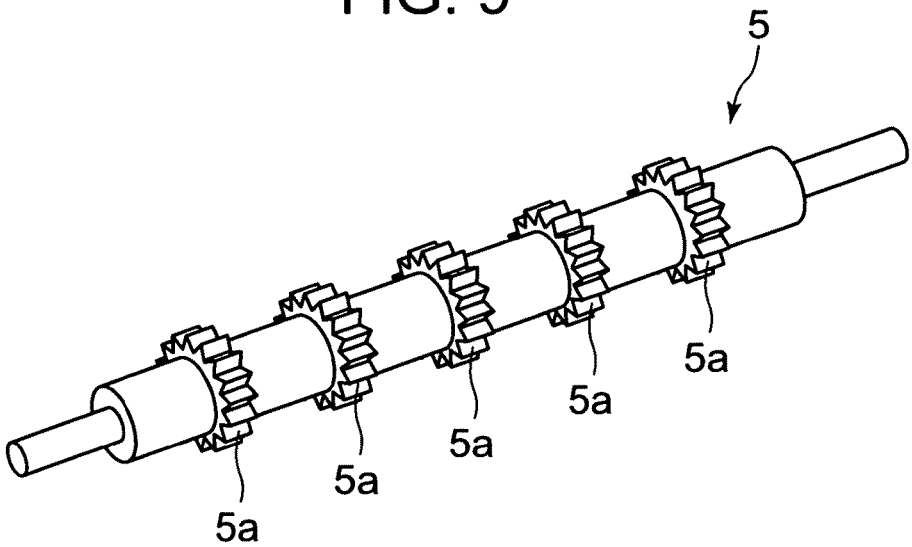
FIG. 9 is a perspective view illustrating another mode of the discharge rollers of the heat-sensitive adhesive label manufacturing device according to the embodiment of the present invention.
Figure 10A:
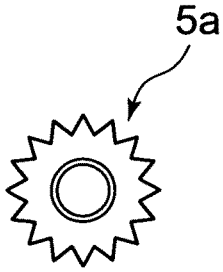
FIG. 10A is a plane view illustrating protrusions of the discharge rollers of the another mode of the heat-sensitive adhesive label manufacturing device according to the embodiment of the present invention.
Figure 10B:
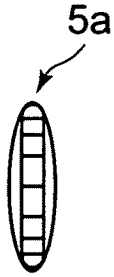
FIG. 10B is a side view of the protrusions.

Note that it is preferred that, similarly to the discharge roller of Patent Document 1, each of the discharge rollers 5 exhibit non-adhesive properties on at least its outer peripheral surface owing to non-adhesive coating or the like. Further, in order to reduce the contact area with the heat-sensitive adhesive layer, as illustrated in FIG. 8, it is preferred that each of the discharge rollers 5 have a plurality of wheel-shaped small protrusions 5*a* which are axially situated at intervals. In addition, as illustrated in FIG. 9, it is more preferred that the wheel-shaped protrusions 5*a* of each of the discharge rollers 5 have a star shape or a gear shape. Further, as illustrated in FIGS. 10A and 10B, it is preferred that the protrusions 5*a* of each of the discharge rollers 5 be formed into a shape which is narrowed toward its outer periphery and has the smaller contact area with the heat-sensitive adhesive layer. However, such an improvement in shape regarding the discharge rollers is not essential, and is unnecessary particularly when a heat-sensitive adhesive which originally exerts relatively small adhesive strength is used.

In the above-mentioned modes, two discharge rollers 5 are provided so as to be opposed to the guide member 6. However, there may be adopted a configuration in which only one discharge roller 5 is provided, and a configuration in which three or more discharge rollers 5 are provided. Note that, as is apparent from FIGS. 4A and 4B, it has been found out that, when the plurality of discharge rollers 5 exist, the heat-sensitive adhesive 9 remarkably adheres to and deposits in the discharge roller 5 closest to the thermal activation section 1. Therefore, it is sufficient to provide the difference in speed as described above such that only the discharge roller 5 closest to the thermal activation section 1 has the peripheral speed different from the peripheral speed of the platen roller 4, and it is unnecessary to particularly limit the peripheral speed of the other discharge roller 5. That is, the other discharge roller 5 may have the same peripheral speed as that of the discharge roller 5 closest to the thermal activation section 1, or the peripheral speed same as or different from that of the platen roller 4. In addition, the other discharge roller 5 may be a driven roller that does not rotate actively. The point of the present invention is to provide at least the difference in peripheral speed between the discharge roller 5 closest to the thermal activation section 1 and the platen roller 4.

In the above-mentioned modes, there is adopted the configuration in which the guide member 6 is provided to be opposed to the discharge rollers 5 and a plane of the guide member 6 is brought into surface-contact with the side (heat-sensitive coloring layer) opposite to the heat-sensitive adhesive layer of the heat-sensitive adhesive sheet 8. This configuration is adopted to reduce a force for adhering to the discharge rollers 5 by decreasing pressure applied from the guide member 6 to the heat-sensitive adhesive sheet 8 and by also decreasing pressure at which the heat-sensitive adhesive layer comes into contact with the discharge rollers 5 on the opposite side of the heat-sensitive adhesive sheet 8. A frictional coefficient of the adhesive side (heat-sensitive adhesive layer) is high, and hence no problem arises in conveyance of the heat-sensitive adhesive sheet 8 by the discharge rollers 5 even when contact is held at low pressure. However, though not shown, there may be adopted a configuration in which an opposed roller is provided instead of the guide member 6. The opposed roller may be a roller that actively rotates or a driven roller that does not actively rotate. Normally, the guide member 6 and the opposed roller are brought into contact with the side of the heat-sensitive adhesive sheet 8 which is out of contact with the heat-sensitive adhesive layer thereof, and hence it is unnecessary to consider preventing adhesion of the heat-sensitive adhesive 9.

What is claimed is:

1. A heat-sensitive adhesive label manufacturing device which manufactures a heat-sensitive adhesive label from a heat-sensitive adhesive sheet having a heat-sensitive adhesive layer, the heat-sensitive adhesive label manufacturing device comprising:

a thermal activation section having a thermal head for heating and thermally activating the heat-sensitive adhesive layer of the heat-sensitive adhesive sheet while the thermal head is in contact with the heat-sensitive adhesive layer, and having a platen roller disposed opposite to the thermal head for conveying the heat-sensitive adhesive sheet between the platen roller and the thermal head to transport the heat-sensitive adhesive sheet in a transport direction; and a label discharge section having a plurality of discharge rollers disposed on a downstream side of the thermal activation section and having a guide member disposed opposite and spaced apart from the plurality of discharge rollers to provide a space therebetween along which the heat-sensitive adhesive sheet is conveyed by the plurality of discharge rollers without being pressed between the plurality of discharge rollers and the guide member;

wherein a discharge roller closest to the thermal activation section among the plurality of discharge rollers is a drive discharge roller configured to undergo rotation at a peripheral speed different from a peripheral speed of the platen roller to convey the heat-sensitive adhesive sheet in the transport direction; and wherein when a rear end portion of the heat-sensitive adhesive sheet reaches the drive discharge roller, rotation of the drive discharge roller stops and the heat sensitive adhesive sheet is held in a state in which a forward end portion of the heat-sensitive adhesive sheet sticks out of a discharge port of the label discharge section toward an exterior thereof.

2. A heat-sensitive adhesive label manufacturing device according to claim 1, wherein a difference in speed between the peripheral speed of the platen roller and the peripheral speed of the discharge roller closest to the thermal activation section is 10% or more.

3. A heat-sensitive adhesive label manufacturing device according to claim 2, wherein the difference in speed between the peripheral speed of the platen roller and the peripheral speed of the discharge roller closest to the thermal activation section is 20% or more to 50% or less.

4. A heat-sensitive adhesive label manufacturing device according to claim 1, wherein the drive discharge roller has an outer diameter different from an outer diameter of the platen roller.

5. A heat-sensitive adhesive label manufacturing device according to claim 1, wherein the drive discharge roller is connected to a drive gear through an intermediation of a transmission gear having a gear ratio different from a gear ratio of a transmission gear for connecting the platen roller and the drive gear.

6. A heat-sensitive adhesive label manufacturing device according to claim 1, further comprising first drive means for driving the drive discharge roller and second drive means different from the first drive means for driving the platen roller.

7. A heat-sensitive adhesive label manufacturing device according to claim 1, wherein at least one of the plurality of the discharge rollers other than the drive discharge roller comprises a driven roller that does not rotate actively.

8. A heat-sensitive adhesive label manufacturing device according to claim 1, wherein the peripheral speed of the drive discharge roller is set 0.7 times as high as the peripheral speed of the platen roller.

9. A heat-sensitive adhesive label manufacturing device according to claim 1, wherein the difference in peripheral speed between the platen roller and the drive discharge roller is 20% to 50%.

10. A heat-sensitive adhesive label manufacturing device for manufacturing a heat-sensitive adhesive label from a heat-sensitive adhesive sheet having a heat-sensitive adhesive layer, the heat-sensitive adhesive label manufacturing device comprising:

a thermal head for heating and thermally activating the heat-sensitive adhesive layer of the heat-sensitive adhesive sheet;

a platen roller rotationally driven to convey the heat-sensitive adhesive sheet between the platen roller and the thermal head to transport the heat -sensitive adhesive sheet in a transport direction; and a plurality of discharge rollers disposed on a downstream side of the thermal head and the platen roller for conveying the heat-sensitive adhesive sheet in the transport direction, a discharge roller closest to the thermal head and the platen roller among the plurality of discharge rollers is a drive discharge roller that is rotationally driven and configured to rotate at a peripheral speed different from a peripheral speed of the platen roller to convey the heat-sensitive adhesive sheet in the transport direction so that when the drive discharge roller comes into contact with one portion of the heat-sensitive adhesive layer of the heat-sensitive adhesive sheet, the heat-sensitive adhesive sheet is caused to slip with respect to the drive discharge roller to cause the drive discharge roller to come into contact with another portion of the heat-sensitive adhesive layer different from the one portion thereof so that a period of time during which any one portion of the heat-sensitive adhesive layer is maintained in a contact state with the drive discharge roller is minimized to thereby prevent the heat-sensitive adhesive from adhering to the drive discharge roller;

wherein when a rear end portion of the heat-sensitive adhesive sheet reaches the drive discharge roller, rotation of the drive discharge roller stops and the heat sensitive adhesive sheet is held in a state in which a forward end portion of the heat-sensitive adhesive sheet sticks out of a discharge port of the label discharge section toward an exterior thereof.

11. A heat-sensitive adhesive label manufacturing device according to claim 10, further comprising a guide member disposed opposite and spaced apart from the drive discharge roller to provide a space therebetween along which the heat-sensitive adhesive sheet is conveyed by the drive discharge roller without being pressed between the drive discharge roller and the guide member.

12. A heat-sensitive adhesive label manufacturing device according to claim 10, wherein the difference in peripheral speed between the platen roller and the discharge roller closest to the thermal head and the platen roller is 20% to 50%.

13. A heat-sensitive adhesive label manufacturing device according to claim 10, wherein a difference in peripheral speed between the platen roller and the drive discharge roller is 10% or more.

14. A heat-sensitive adhesive label manufacturing device according to claim 10, wherein the drive discharge roller has an outer diameter different from an outer diameter of the platen roller.

15. A heat-sensitive adhesive label manufacturing device according to claim 10, wherein the drive discharge roller is connected to a drive gear through an intermediation of a transmission gear having a gear ratio different from a gear ratio of a transmission gear connecting the platen roller and the drive gear.

16. A heat-sensitive adhesive label manufacturing device according to claim 10, wherein at least one of the plurality of the discharge rollers other than the drive discharge roller comprises a driven roller that does not rotate actively.

* * * * *